US010395801B2

(12) United States Patent
Denerf et al.

(10) Patent No.: US 10,395,801 B2
(45) Date of Patent: Aug. 27, 2019

(54) MECHANICAL ASSEMBLY BY MEANS OF AUTOGENOUS RIVETING

(71) Applicant: Legrand France, Limoges (FR)

(72) Inventors: Didier Denerf, Bosmie L'aiguille (FR); Christophe Lequeux, Boisseuil (FR); Philippe Fortanier, Panazol (FR); Eric Labreze, Panazol (FR); Laurent Clisson, Bourg-la-reine (FR); Matthieu Francillout, Massy (FR); Bertrand Cahuzac, Sartrouville (FR); Richard Retout, Nanterre (FR)

(73) Assignee: LEGRAND FRANCE, Limoges (FR)

( * ) Notice: Subject to any disclaimer, the term of this patent is extended or adjusted under 35 U.S.C. 154(b) by 168 days.

(21) Appl. No.: 15/449,358

(22) Filed: Mar. 3, 2017

(65) Prior Publication Data

US 2017/0178769 A1 Jun. 22, 2017

Related U.S. Application Data

(62) Division of application No. 14/400,157, filed as application No. PCT/FR2013/051027 on May 7, 2013.

(30) Foreign Application Priority Data

May 11, 2012 (FR) ..... 12 54310

(51) Int. Cl.
*H01R 43/00* (2006.01)
*H01B 13/00* (2006.01)
(Continued)

(52) U.S. Cl.
CPC ..... *H01B 13/0036* (2013.01); *H01B 5/08* (2013.01); *H01B 13/00* (2013.01); *H01R 4/06* (2013.01);
(Continued)

(58) Field of Classification Search
CPC ..... D07B 2201/209; H01R 4/06; H01R 4/10; H01R 35/02; H01R 43/04; Y10T 29/53209; Y10T 29/49174; Y10T 29/49194
(Continued)

(56) References Cited

U.S. PATENT DOCUMENTS 3,038,958 A * 6/1962 Swengel ..... H01R 4/186 174/75 R
3,878,318 A 4/1975 Ziegler, Jr.
(Continued)

FOREIGN PATENT DOCUMENTS

DE 10 2006 013 347 9/2007
EP 0 634 810 1/1995
(Continued)

OTHER PUBLICATIONS

PCT/FR2013/051027 International Search Report dated Aug. 6, 2013 (4 pages including English translation).

*Primary Examiner* — Thiem D Phan
(74) *Attorney, Agent, or Firm* — Brinks Gilson & Lione; John C. Freeman

(57) ABSTRACT

A mechanical assembly of a multi-strand cable including a plurality of strands and a substrate, the plurality of strands being aligned at the substrate in a first direction and the substrate having a convex edge in a plane perpendicular to the first direction. The plurality of strands is assembled on the substrate by swaging the strands around the convex edge, leading to the deformation of a portion of the strands around said convex edge. The substrate includes an opening in a plane substantially parallel to the first direction, the edge of which forms at least one portion of the convex edge. The swaging operation is carried out on the portion of the strands positioned between the edges of the opening such that a
(Continued)

portion of the plurality of punched strands passes through the opening and projects around the convex edge onto the top and bottom sides thereof.

2 Claims, 5 Drawing Sheets

(51) Int. Cl.
*H01R 4/06* (2006.01)
*H01R 4/10* (2006.01)
*H01R 43/04* (2006.01)
*H01B 5/08* (2006.01)

(52) U.S. Cl.
CPC ..... *H01R 4/10* (2013.01); *H01R 43/04* (2013.01); *Y10T 29/49194* (2015.01)

(58) Field of Classification Search
USPC ..... 29/868, 842, 844, 857, 874, 715, 34 R, 29/522.1, 597, 717, 729, 748, 751, 753
See application file for complete search history.

(56) References Cited

U.S. PATENT DOCUMENTS

| | | | | |
|---|---|---|---|---|
| 4,976,132 | A | 12/1990 | Shaffer | |
| 5,724,716 | A * | 3/1998 | Perisho | B60T 7/04 29/517 |
| 2013/0244511 | A1 | 9/2013 | Van Tilburg | |

FOREIGN PATENT DOCUMENTS

| | | |
|---|---|---|
| EP | 2 458 694 | 5/2012 |
| FR | 2 736 471 | 1/1997 |
| FR | 2 935 550 | 3/2010 |
| WO | WO 2010/026331 | 3/2010 |

* cited by examiner

MECHANICAL ASSEMBLY BY MEANS OF AUTOGENOUS RIVETING

This application is a divisional of and claims priority to U.S. application Ser. No. 14/400,157 filed Nov. 10, 2014, International Application No. PCT/FR2013/051027 filed May 7, 2013 and French Application No. 1254310 filed May 11, 2012, the entire contents of each are incorporated herein by reference.

BACKGROUND

The present invention relates to the field of the mechanical assembly of a multi-strand cable with a support.

SUMMARY

The mechanical and electrical assembly of two electrical conductors by plastic deformation is known as an advantageous alternative to welding, but only in the situation where a wire conductor may be enclosed between two thicknesses of flat conductors one of which at least is plastically deformed.

A first example of this technique is given in patent document FR 2 736 471, which proposes to simultaneously deform the two thicknesses of the flat conductor by embossing, according to a technique known by those skilled in the art under the name clinching.

A second example of this technique is given in patent document DE 10 2006 013 347, which proposes to deform the flat conductor so as to wrap it around the wire conductor, and to crimp the latter by imprisoning it in the deformed flat conductor.

A third example of this technique is given in patent document EP 0 634 810, according to which the flat conductor is cut and deformed to constitute two sheets defining therebetween a tunnel inside which the wire conductor is inserted, the two sheets of this flat conductor being then deformed again to enclose the wire conductor.

Mention may also be made of U.S. Pat. No. 3,878,318 in which the conductor is packed in a support having a channel with a substantially isosceles trapezoidal shape, the small base forming an opening, so that the sides enclose the conductor.

Thus, in all these examples, the support encloses the wire conductor. Yet, the implementation of these techniques shows that they may be complex to realize, in particular when the assembly must be realized in a cluttered environment. In addition, this type of assembly often requires to be protected from the external environment to preserve its electrical and mechanical properties over time, the connection between the two components is not airtight.

Patent application EP 2 458 694 describes a device in which the support includes a slot and a pliers-type tool the upper portion of which, being either planar or concave, crushing the conductor in order to pack it around the slot. However, this technique seems to give bad results in the case of a multi-strand conductor, the strands fraying around the slot, which may thus degrade the mechanical strength and/or the sought electrical contact.

In brief, the methods discussed above act mainly by compression of the strands thus encountering the limits of contact quality and of deformation of the crimping method in particular the residual gaps, the relaxation tendency of which are the most known.

The invention, in this context, has as an object to propose a mechanical assembly of a multi-strand cable and of a support which resolves all or part of the aforementioned drawbacks.

To resolve one or more of the preceding mentioned drawbacks, a mechanical assembly of a multi-strand cable comprising a plurality of strands and of a support, the plurality of strands being aligned at the height of the support along a first direction and the support exhibiting in a plane perpendicular to the first direction a convex edge, the assembly of the plurality of strands on the support is realized by embossing the plurality of strands around the convex edge resulting in a deformation of a portion of the plurality of strands around the convex edge characterized in that the support further comprises a slot in a plane substantially parallel to the first direction and the border of which forms at least one portion of the convex edge, the embossing being realized on the portion of the strands positioned between the edges of the slot such as a portion of the plurality of the embossed strands passes through the slot and overflow around the convex edge on its upper and lower sides, and in that the strands having been compressed during the assembly, the strands are joined together and to the support by creeping.

Thus, it is the deformation of the multi-strand cable around the convex edge which ensures the connection with the support, the cable somehow enclosing the support. This assembly also has the advantage of not requiring a supply of material, unlike brazing. In addition, the creeping of the strands advantageously creates an assembly without gaps, which allows preserving the mechanical and electrical properties over time. Moreover, the support may advantageously be made from a rigid material such as PCB boards, the operation not requiring a deformation of the support.

Particular characteristics or embodiments, usable alone or in combination, are:

the border of the slot forming in the perpendicular plane two convex edges facing each other, the embossed strands take on in this plane an X-shape enclosing the convex edges;

the multi-strand cable exhibits a ductility greater than or equal to that of the support;

the support has a planar, tubular or cylindrical shape, the area of the slot may be locally assimilated to an area comprising an average plane parallel to the first direction;

the multi-strand cable is a wire conductor; and/or the support comprises a tab foldable above the convex edge to partially surround a portion of the multi-strand cable.

Thus, when the support comprises a slot, the strands advantageously overflow around the edge of the slot thanks to their compacted and crept state.

In a second aspect of the invention, a multi-strand cable comprises at least one assembly as described above.

In a third aspect of the invention, a mechanical assembly method of a multi-strand cable comprising a plurality of strands aligned along a first direction at the height of a support exhibiting in a plane perpendicular to the first direction a slot the edge of which forms in a plane perpendicular to the first direction two convex edges facing each other, is characterized in that a riveting operation is realized by means of a first tool allowing:

embossing the multi-strand cable in an area corresponding to the slot in order that a portion thereof penetrates in the slot and bypasses the convex edge;

compacting the embossed portion of the multi-strand cable around the slot;

creeping the multi-strand cable in the embossed area so that the strands are joined together and with the support.

Particular characteristics or embodiments, usable alone or in combination, are:

the first tool comprises a die in which the area of the convex edge of the support is disposed and a punch applying on the multi-strand cable in the area of the slot of the support.

a second tool allows guiding the punch to realize the embossing and compact a portion of the multi-strand cable on the side of the face of the support facing the multi-strand cable;

the second tool is a blank holder;

the riveting operation of the multi-strand cable on the support comprises an optimization of the distribution of the compacted material of the multi-strand cable on the convex edges via an imprint formed in the die the dimensions of which are adapted to distribute the material coming from the multi-strand cable over the surface of the convex edges;

a pre-heating operation of the multi-strand cable is realized prior to the riveting operation;

a pre-compacting operation of the multi-strand cable is realized prior to any operation;

a post-heating operation of the assembly is realized subsequently to the riveting operation.

This assembly method advantageously allows an assembly even in a relatively narrow environment to the extent that it may be realized with a portable pliers having suitable jaws, the clamping pressure may be only manually originated, in particular for the most malleable materials.

The invention will be better understood upon reading the following description, given solely by way of example, and with reference to the appended figures in which:

DETAILED DESCRIPTION

Figure 1:
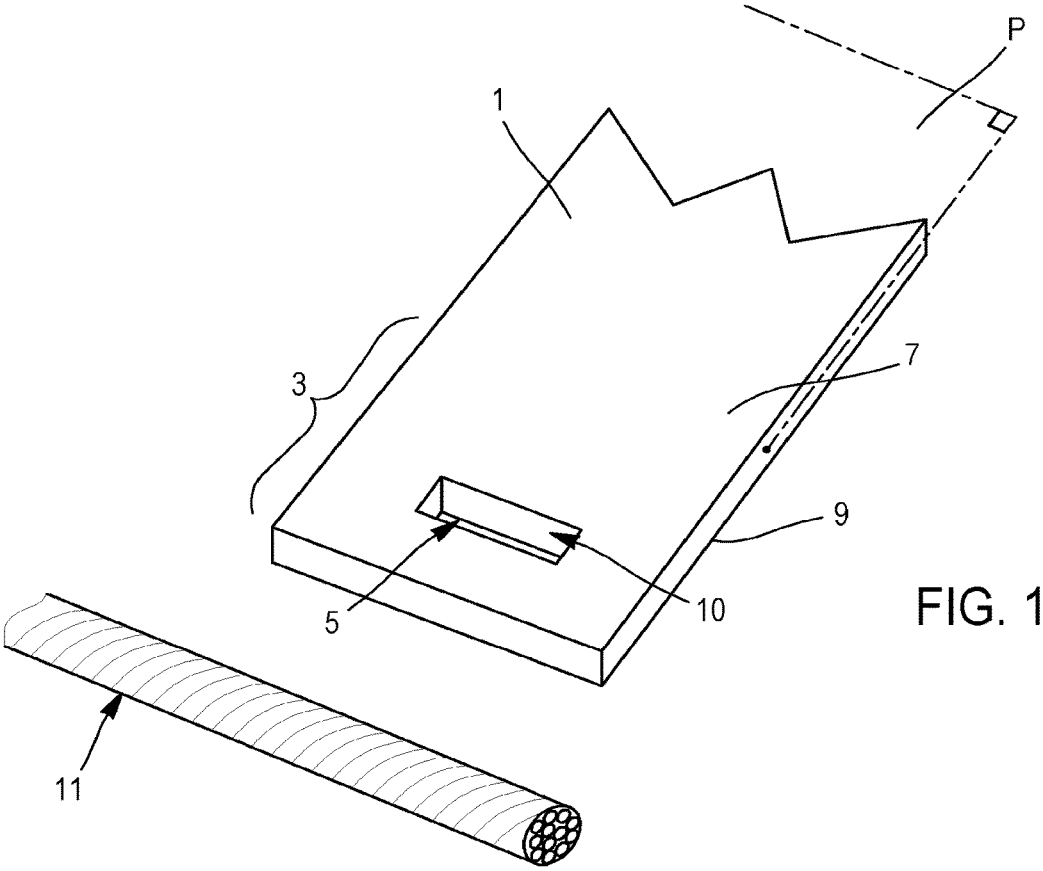
FIG. 1 is a perspective view of a multi-strand cable and a support usable for realizing an assembly in accordance with an embodiment of the invention and observed before assembly.

Referring to FIG. 1, a support 1 comprises a flat area 3 extending substantially in a midplane P in which a slot 5 is pierced, putting a first face 7 into communication with a second face 9 of the support 1. The slot comprises a convex edge 10.

Facing the slot 5, a multi-strand cable 11 is positioned on the first face 7. By multi-strand cable, is meant a cable composed of a plurality of elementary strands made from a same material. Most often, the elementary strands are held together to form the cable either by twisting, or by weaving. There are known in particular numerous examples of multi-strand cables in the field of electrical copper cables.

Figure 2:
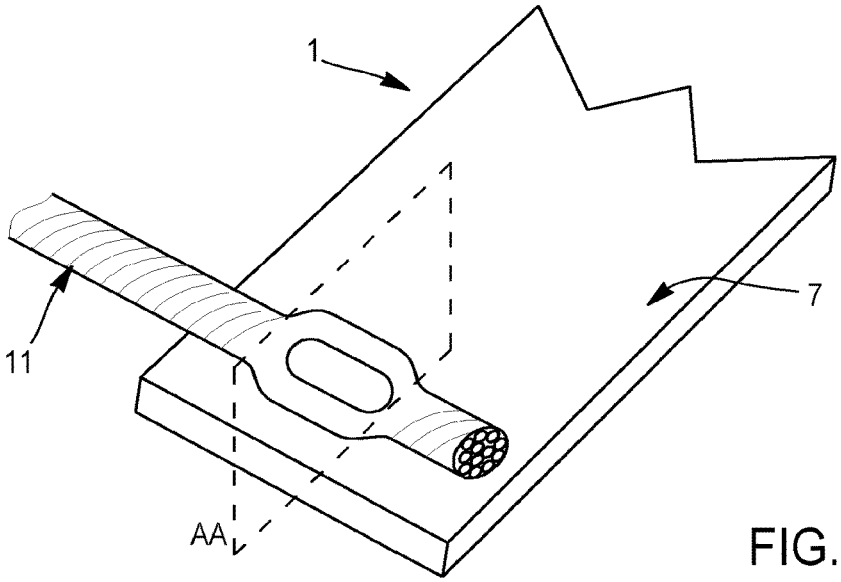
FIG. 2 is a perspective view of the multi-strand cable and of the support of FIG. 1 after assembly according to the embodiment of the invention.

Once assembled, FIG. 2, the strands of the cable 11 form a compact material around and in the slot 5, one portion of this material overflowing on the rims of the slot 5 and in particular on the rim of the second face 9.

Figure 3:
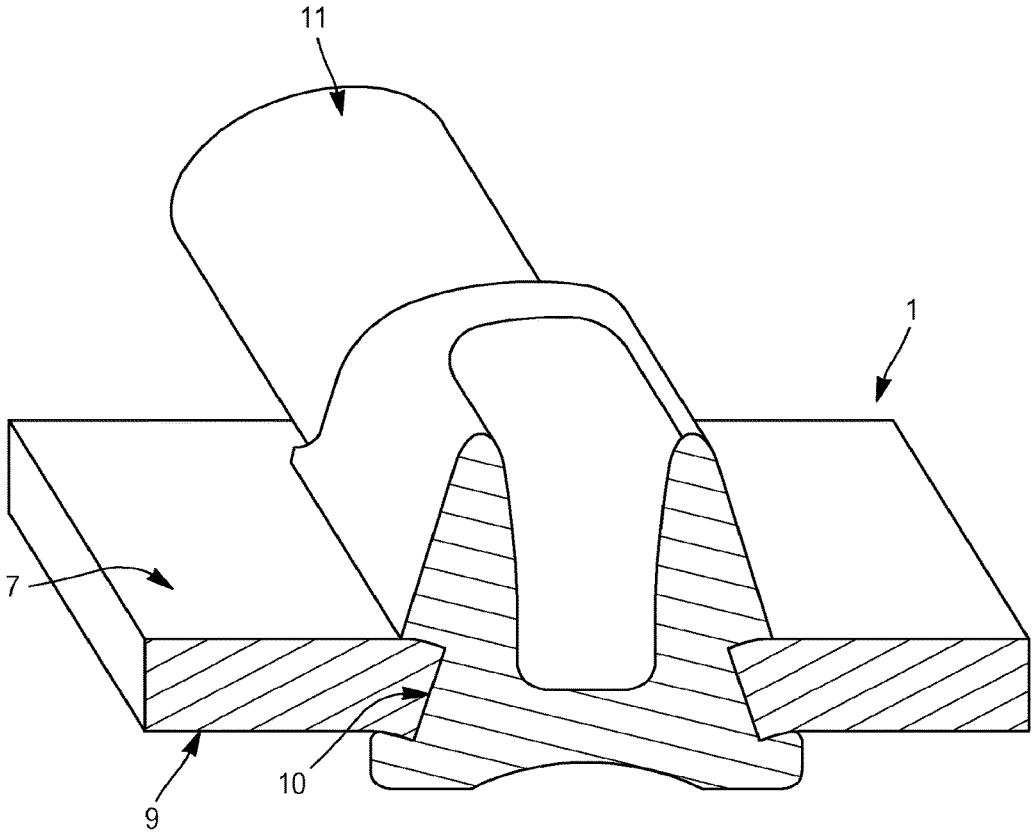
FIG. 3 is a sectional perspective view, along the plane AA, of the assembly of FIG. 2.

Thus, the sectional view of FIG. 3, shows that the material of the strands has been amalgamated and substantially forms an X-shape, by passing through and filling the slot 5 and by overflowing on its rims, thus locking the support in the multi-strand cable 11. This shape is similar to that of a rivet, which would have been inserted in the slot and then crushed around the support, which explains the term autogenous riveting used to name this type of assembly.

This assembly known for a single-strand wire cable in French patent FR 2 935 550 allows, after deformation of the material, forming an X-shape around the edges of the slot so that the deformed material locks any movement of the cable around the slot.

In the present situation, an assembly by deformation of the material of a multi-strand cable around the edges of the slot cannot be deduced from a simple transposition of the application of an assembly for a single-strand cable to an assembly for a multi-strand cable. Considering this transposition requires overcoming a prejudice. The prejudice lies in particular in that the diameter of a multi-strand cable comprises a sum of smaller diameters for each one of the contiguous strands. The intention to apply a deformation to a multi-strand cable assumes that the strands may break during their deformation and may reduce the strength of such an assembly.

The one skilled in the art would pre-assume that the X-punching might be destructive, with tears and de-cohesion of the strands resulting from too heterogeneous organization and holding of the wires. He will also think that it is necessary that each strand merges until a maximum metallurgical continuity is obtained in order to reduce to the minimum the events of the interstitial strain hardening type to the periphery of the compacted wires.

This prejudice is overcome by the discovery of effects which are combined together thus allowing realizing an assembly having a high mechanical strength of a multi-strand cable in a support including a convex surface and, particularly, an opening. In this case, the unexpected effects of the described assembly are listed below:

a metallurgical deformation around the point of strain hardening without breaking of most strands, leading by creeping to an homogenous material area;

a good mechanical quality of anchoring thanks to the complexity of the shape of the contact areas between the compacted-crept strands despite some tears and de-cohesion of the wire braid;

a higher quality of the assembly from a partial compaction or with a punching at the periphery of the welded and compacted area.

Indeed, the compaction of the material being deformed and coming from the strands exhibits a mechanical strength of the assembly beyond what could be considered. An effect similar to a crushed braid which would exhibit a double resistance in particular due, on the one hand, to the compaction associated with the crushing of the material and, on the other hand, to the resistance of the intermeshing strands forming a knot once crushed.

In particular, each strand is quite deformed so that its circumferential length/sectional area ratio, which is minimum in the initial state of a cylindrical strand, increases quite substantially. In addition, the entanglement of the strands creates a helical effect which consolidates the joining of the strands together. Moreover, the high compression of the strands causes surface effects between the strands which may provoke in some configurations a virtually welding of the strands therebetween.

The deformation of a multi-strand cable engaged by compaction of the material around the opening of the support is obtained, on the one hand, thanks to the punch and, on the other hand, thanks to a mold, or a die, allowing folding the deformed material around the edges of the opening. The description that follows allows supporting the means required for obtaining such an assembly between a multi-strand cable and a support comprising a convex face. Indeed, it seems that the support may simply have a surface with a convex section in a plane perpendicular to the main orientation of the strands. The deformation of the cable is then oriented by tools and wedges so that there is a creeping of the strands around the convex edge, the pressure forces being applied in the perpendicular plane.

This assembly is realized in the following way, FIGS. 4 and 5.

A tool comprises a die 31, a blank holder 32 and a punch 33.

Figure 4:
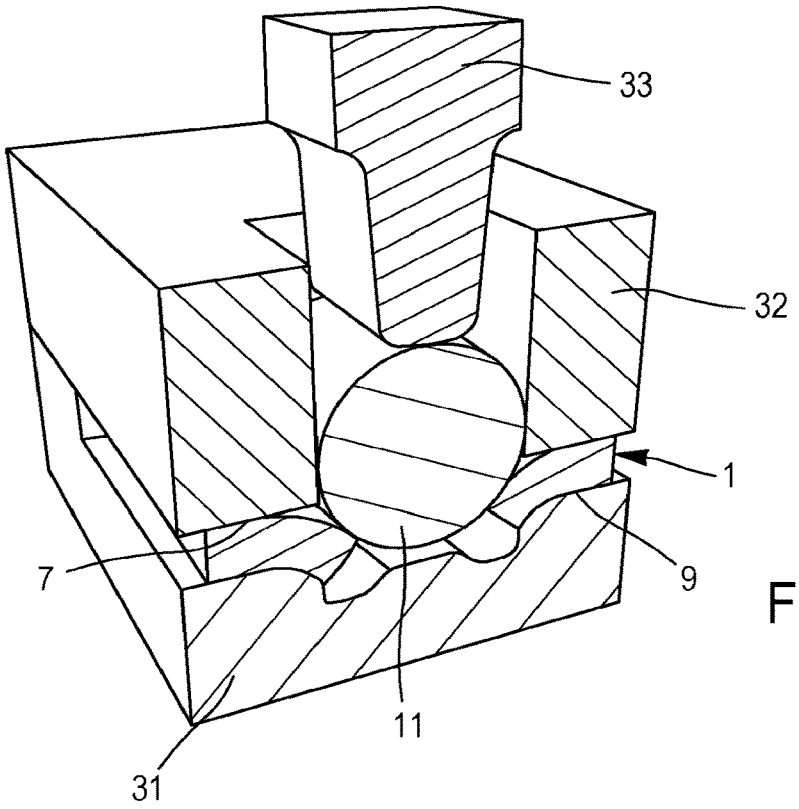
FIG. 4 is a schematic sectional perspective view of a multi-strand cable, of a support and of a tool, these elements being usable for realizing an assembly in accordance with an embodiment of the invention, and this set of elements being observed before realization of the assembly.

Firstly, FIG. 4, the second face 9 of the support 1 is placed on the die 31, which exhibits clearances 310 opposite to and under the edges of the slot 5.

The multi-strand cable 11 is then placed on the first face 7 of the support 1, then the blank holder 32 is deposited on the support 1 and around the multi-strand cable 11 in the area where the assembly has to be performed. This blank holder 32 has a function of avoiding the lateral creeping of the multi-strand cable 11.

Figure 5:
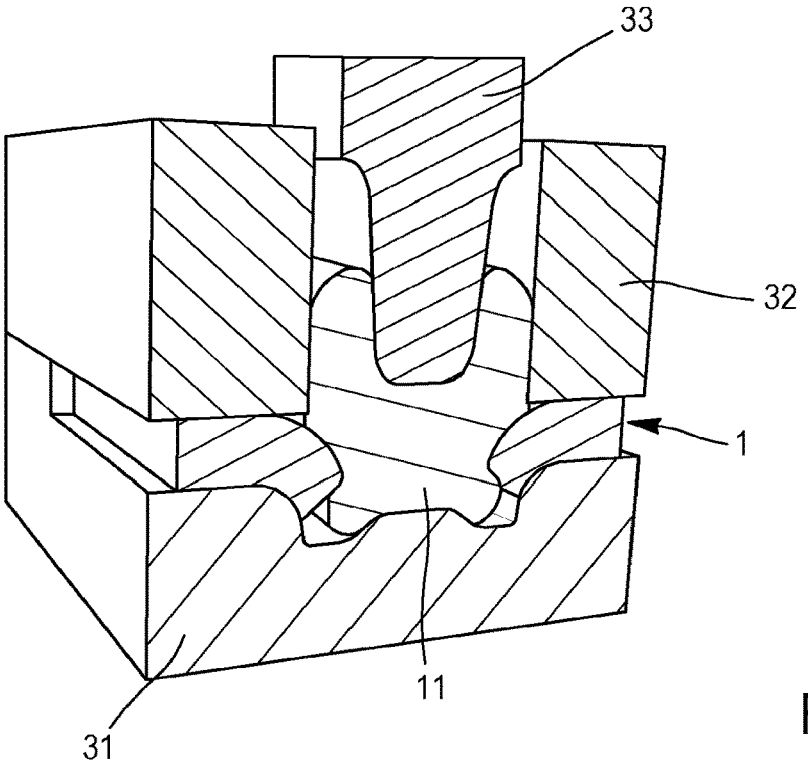
FIG. 5 is a schematic sectional perspective view of the elements of FIG. 4 observed after realization of the assembly.

The punch 33 is then applied, FIG. 5, on the multi-strand cable 11 through a well of the blank holder 32 so as to locally deform the multi-strand cable 11 by embossing so as to make it creep through the slot 5 toward the clearances 310 of the die 31. The stresses exerted by the punch 33 on the one hand, and the die 31 and the blank holder 32 on the other hand, compact the strands of the cable into and around the slot to form an aggregate of wires joined together by creeping. It will be noted that the tip of the punch 33 has a width smaller than the distance between the convex edges of the slot in order to penetrate in part into this slot while leaving room for the strands between the punch and the convex edges.

Figure 6A:
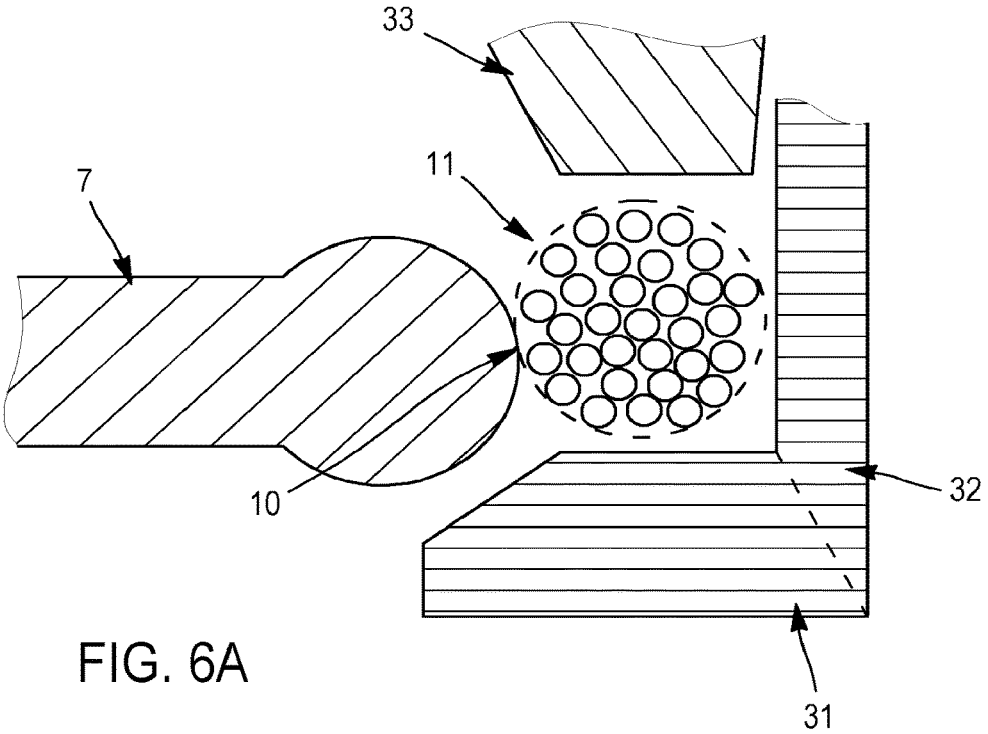
FIGS. 6A and 6B are schematic sectional views of a multi-strand cable, of a support and of a tool, these elements being usable for realizing an assembly in accordance with an embodiment of the invention in the case where the support comprises only one convex surface, and this set of elements being observed before realization of the assembly and after realization of the assembly.
Figure 6B:
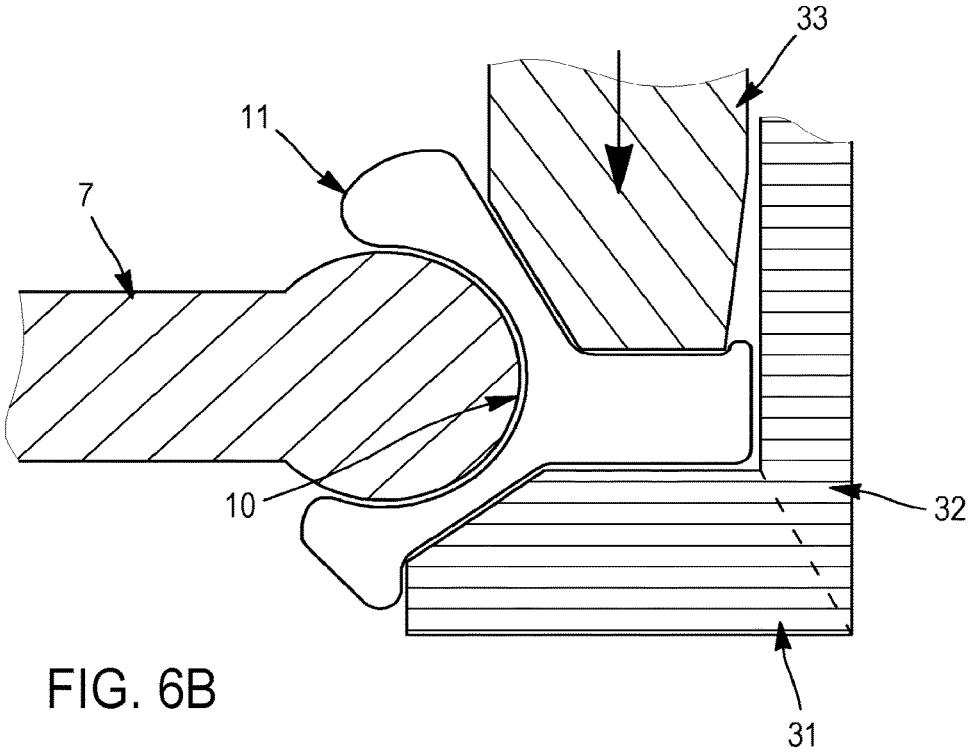

In the more general case where the support comprises a convex surface, the blank holder 32 and the die 31 are joined together and form a chamber around the convex surface so that the material of the multi-strand cable flows toward and around the convex surface, FIG. 6.

To realize this type of assembly, it is hence advantageous to use materials with different ductilities. In particular, the material of the strands of the cable may exhibit a ductility greater than or equal to that of the support. Thus, for example, the cable is made from copper and the support from brass. The malleability of the cable may be advantageously chosen greater than the malleability of the support.

It is known that one of the advantages of the multi-strand cables lies in the improvement of flexibility of the cable and the reduction of weight thereof in comparison with an equivalent single-strand cable. Also, during the embossing operation, the forces to be implemented to compact and creep the material of the strands may be substantially decreased to reach values lower than 350 DaN during the assembly of a copper multi-strand conductive cable with a diameter of about 1.8 mm for low voltage. This number is to be compared with a force of about 700 DaN required to clinch the same wire. The tool may then be integrated into manual pliers, with or without assistance.

In a first alternative of this assembly method, the strands of the multi-strand cable are heated beforehand so as to be more ductile during the assembly operation.

In a second alternative, the strands are compacted beforehand so as to improve the cohesion therebetween.

This second alternative may be combined with the first alternative, the compaction then taking place before the heating operation, or even the compaction may generates the required prior heating.

In a third alternative, the obtained assembly is heated so as to improve the strength of the aggregate formed by the compressed strands.

According to a fourth alternative embodiment, the support comprises a closed or open slot. When it is closed, it comprises, for example, four convex edges to form a parallelepiped. It is then generally pierced in the support.

When the slot is open, it comprises, in a parallelepipedal-shaped example, three convex edges and an opening on one of the edges. Typically, this type of slot is used when it must be located at the edge of the support. In the latter case, the support does not enclose one of the sides of the slot. The assembly of the invention remains quite efficient when a cable is assembled to a support including an open slot in particular because a mold, otherwise called a die, retains the material around the three edges of the slot and allows compaction of the latter following its deformation.

The slot may, in fact, be with various shapes, for example a T-shape or a V-shape. The choice is then made based on the connection to realize in order to optimize the strength of the assembly.

Figure 7:
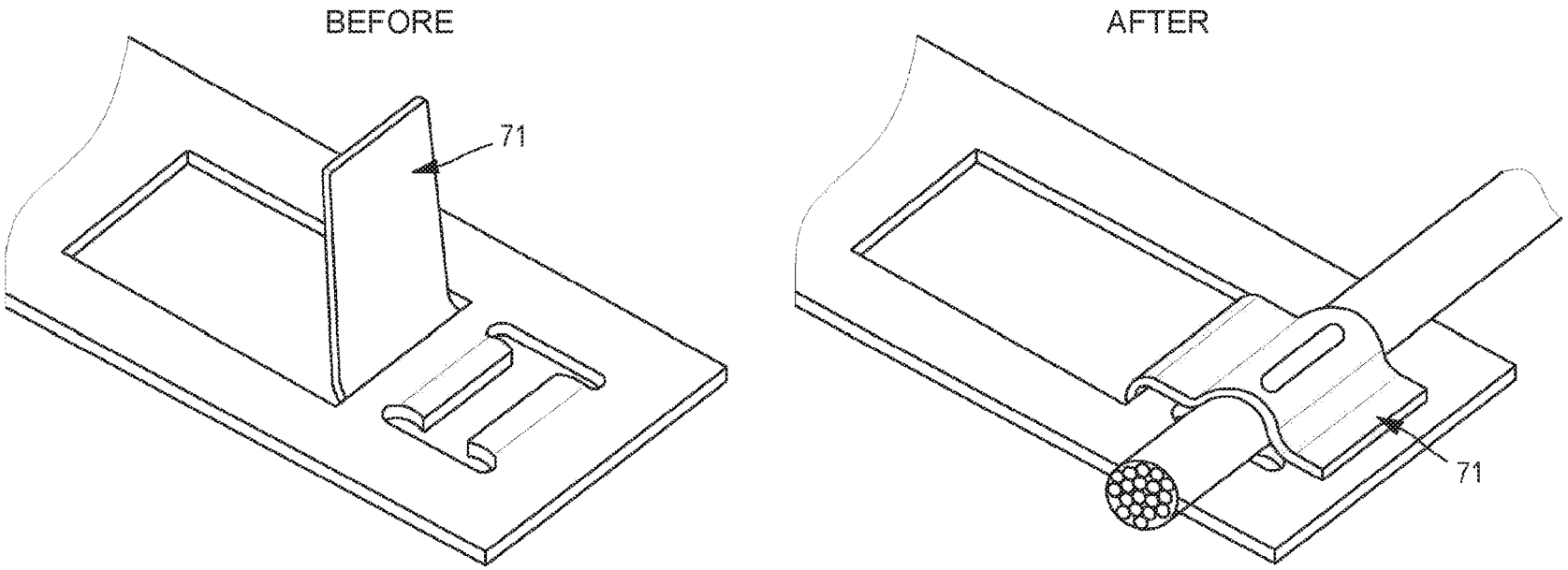
FIG. 7 is a schematic perspective view of a multi-strand cable and of a support in an alternative in which the support comprises a tab serving as a blank holder.

In a fifth alternative embodiment, FIG. 7, the support comprises a tab 71 which is folded on the multi-strand cable to serve as a blank holder or a die. By remaining in place, it also participates in the mechanical strength by providing a clinching function.

In a sixth alternative, not illustrated, the support itself is a multi-strand wire put into shape by the die.

The invention has been illustrated and described in detail in the drawings and preceding description. This should be considered as illustrative and given as an example and not as limiting the invention to that description alone. Numerous alternative embodiments are possible.

For example, the support may have flat, cylindrical or tubular shapes. The tool is then adapted to the shape of the support so as to guide the material of the strands of the cable and optimize its distribution on the rims of the slot.

In the same way, this assembly mode may be used to assemble 2 or more wires, all being multi-strand wires or some being multi-strand wires while the others are single-strand wires, with or without support by adapting the tool to the assembly to be realized.

This type of assembly seems to be particularly interesting in use with multi-strand electrical cables and conductive supports. Indeed, it ensures a good electrical conductivity. It has thus been found that when an aluminum multi-strand cable is used, the riveting operation breaks the thin layer of alumina covering the strands by default, thus allowing a good electrical conductivity without resorting prior pickling.

Moreover, in a conventional assembly of a multi-strand cable, there often appear phenomena of damp rising by capillary migration from the contact area. To combat these phenomena, the connections are conventionally protected by sealing and plugging solutions by polymers. By compacting the strands, the described assembly intrinsically limits this type of rising.

In the claims, the word "comprising" does not exclude other elements and the indefinite article "a/an" does not exclude a plurality.

The invention claimed is:

1. A method of assembling a multi-strand cable having a plurality of strands aligned along a first direction at a height of a support having a slot formed in a plane perpendicular to a first direction and having two convex edges facing each other, the method comprising:

performing a pre-compacting operation of the multi-strand cable;

subsequent to the pre-compacting operation, performing a pre-heating operation of the multi-strand cable;

subsequent to the performing a pre-heating operation, performing a riveting operation with a first tool comprising a die, a blank holder, and a punch, wherein the riveting operation comprises:

embossing a portion of the multi-strand cable in an area corresponding to the slot in order that the embossed portion of the multi-strand cable penetrates in the slot and bypasses the two convex edges;

compacting the embossed portion of the multi-strand cable around the slot;

creeping the multi-strand cable in the area so that the plurality of strands are joined together and with the support;

optimizing a distribution of compacted material of the multi-strand cable on the convex edges via an imprint formed in the die, dimensions of which are adapted to distribute material coming from the multi-strand cable over a surface of the two convex edges; and wherein the support is disposed in the die at a height of the slot and the punch applies on the multi-strand cable in the area of the slot of the support; and wherein the blank holder allows guiding the punch to perform the embossing and compacting and creeping a portion of the multi-strand cable on a side of a face of the support facing the multi-strand cable.

2. The method according to claim 1, wherein a post-heating operation is performed subsequent to the riveting operation.

* * * * *